US011821396B2

(12) United States Patent
Schmieder et al.

(10) Patent No.: US 11,821,396 B2
(45) Date of Patent: Nov. 21, 2023

(54) FUEL INJECTOR

(71) Applicant: Robert Bosch GmbH, Stuttgart (DE)

(72) Inventors: Dietmar Schmieder, Markgroeningen (DE); Kai Gartung, Stuttgart (DE); Tobias Keller, Gueglingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 17/634,889

(22) PCT Filed: Oct. 19, 2020

(86) PCT No.: PCT/EP2020/079343

§ 371 (c)(1),
(2) Date: Feb. 11, 2022

(87) PCT Pub. No.: WO2021/083701

PCT Pub. Date: May 6, 2021

(65) Prior Publication Data

US 2022/0290642 A1 Sep. 15, 2022

(30) Foreign Application Priority Data

Oct. 29, 2019 (DE) ..... 10 2019 216 587.7

(51) Int. Cl.
*F02M 55/00* (2006.01)

(52) U.S. Cl.
CPC ..... *F02M 55/005* (2013.01); *F02M 2200/856* (2013.01); *F02M 2200/858* (2013.01); *F02M 2200/9015* (2013.01)

(58) Field of Classification Search
CPC ..... F02M 55/005; F02M 2200/856; F02M 2200/858; F02M 2200/9015
(Continued)

(56) References Cited

U.S. PATENT DOCUMENTS

2007/0044767 A1* 3/2007 Kojima ..... F02M 53/043 123/470
2009/0229575 A1* 9/2009 Giorgetti ..... F02M 61/14 285/318

(Continued)

FOREIGN PATENT DOCUMENTS

DE 10359299 A1 8/2005
DE 102017207091 A1 1/2018
WO 0238950 A1 5/2002

OTHER PUBLICATIONS

International Search Report for PCT/EP2020/079343, dated Dec. 9, 2020.

*Primary Examiner* — Erick R Solis
(74) *Attorney, Agent, or Firm* — NORTON ROSE FULBRIGHT US LLP; Gerard Messina

(57) ABSTRACT

A fuel injector having an improved sealing of an intake nozzle with respect to the receiving opening of a fuel distribution rail. A support ring, which engages with the sealing ring on the intake side, is provided at the intake nozzle. The support ring includes a planar underside for resting on a shoulder of the intake nozzle and a V-shaped contact surface facing the sealing ring. The support ring, which is acted on by the sealing ring, is provided with the V-shaped conical contact surface for the sealing ring that ensures that in the case of increased pressures, a minor radial escape of the support ring is made possible to the radial inside and outside and thus radial gaps and an extruding of the sealing ring into same are prevented.

12 Claims, 8 Drawing Sheets

(58) Field of Classification Search
USPC ..... 123/470
See application file for complete search history.

(56) References Cited

U.S. PATENT DOCUMENTS

| | | | | |
|---|---|---|---|---|
| 2009/0308954 | A1* | 12/2009 | Giorgetti | F02M 61/14 239/569 |
| 2010/0071668 | A1* | 3/2010 | Biasci | F02M 69/465 123/470 |
| 2016/0281857 | A1 | 9/2016 | Beckmann et al. | |
| 2019/0219015 | A1* | 7/2019 | Pilgram | F02M 55/005 |
| 2021/0190023 | A1* | 6/2021 | Shaeena | F02M 61/14 |

* cited by examiner

FUEL INJECTOR

FIELD

The present invention is directed to a fuel injector.

BACKGROUND INFORMATION

In FIG. 1, a fuel injection device from the related art whose intake nozzle is sealed with respect to the receptacle cup of a fuel distribution rail with the aid of a conventional sealing ring made of elastomer, is shown by way of example. The fuel injection device is suitable in particular for use in fuel injection systems of mixture-compressing, spark-ignited internal combustion engines. Numerous fuel injectors of this type are available in the related art; German Patent No. DE 103 59 299 A1 being mentioned here by way of example.

A fuel injector that has a conical connecting piece on the intake side is described in German Patent Application No. DE 10 2017 207 091 A1. The connecting piece includes a sealing section, at which an annular sealing element for sealing with respect to the receptacle cup of a fuel distribution rail is situated. The annular sealing element circumferentially encloses the sealing section with regard to a longitudinal axis. Furthermore, the annular sealing element is supported at the lower end of the sealing section with the aid of a support ring. The sealing section of the connecting piece is designed to have an enlarging circumference, i.e., a conicity, along the longitudinal axis at least in the area in which the annular sealing element and the support ring enclose the connecting piece.

SUMMARY

A fuel injector according to the present invention may have the advantage that an improved sealing of an intake nozzle with respect to the receiving opening of a fuel distribution rail is implemented. In accordance with an example embodiment of the present invention, in addition, a support ring, which grips the sealing ring on the intake side, is advantageously provided at the intake nozzle, the support ring having a planar bottom side for resting on a shoulder of the intake nozzle and a V-shaped contact surface facing the sealing ring. According to an example embodiment of the present invention, the support ring, which is being acted on by the sealing ring, is provided with this V-shaped conical contact surface for the sealing ring that ensures that in the case of increased pressures a minor radial escape of the support ring in a radially inward and outward manner is made possible and thus radial gaps are always prevented.

The measures disclosed herein make advantageous refinements and improvements of the fuel injector possible.

In accordance with an example embodiment of the present invention, the support ring advantageously has a slightly larger radial extension in the area including the V-shaped contact surface than over the remaining axial extension of the support ring. In this way, it is possible to insert the support ring into the receiving space between the fuel injector and the connecting piece by pressing this upper area of the support ring in a mild radial manner. As a result of the fluid pressure, two force components act via the sealing ring on the two wings of the V-shaped contact surface of the support ring. These forces result in a minor elastic deformation of the support ring, namely in the thin-walled sections radially inside and outside below the contact surface in the radially slightly larger upper area. This prevents the sealing ring from extruding between the support ring and the walls of the receiving opening or of the connecting piece, since no undesirable gaps are able to form. As a result of the fact that the support ring rests on the intake nozzle in an axially planar manner, radial movement of the fuel injector in the receiving opening is still possible to some extent. Damage to the fuel injector or to the walls of the connecting piece is excluded.

In accordance with an example embodiment of the present invention, the intake nozzle may be particularly advantageously designed in such a way that the diameter of an end collar on the intake side and the diameter of the intake nozzle are selected to have the same size at the height of the support ring. It is possible in this way to install the support ring via the end collar without any problems. Ideally, the support ring may have two wings of the V-shaped contact surface that extend to different heights, the radially inner wing having a smaller height in the axial direction than the height of the radially outer wing.

By pressing a radial support disk at the intake nozzle of the fuel injector, the fuel injector may be captively preinstalled in the receiving opening of a connecting piece of a fuel distribution rail. The radial support disk is advantageously situated at an end collar of the intake nozzle, viewed in the flow direction, even upstream from the sealing ring installed on the intake nozzle. In this way, the radial support disk may be attached at the intake nozzle of the fuel injector very easily and cost-effectively.

BRIEF DESCRIPTION OF THE DRAWINGS

Exemplary embodiments of the present invention are illustrated in the figures in a simplified manner and explained in greater detail in the description below.

DETAILED DESCRIPTION OF EXAMPLE EMBODIMENTS

Figure 1:
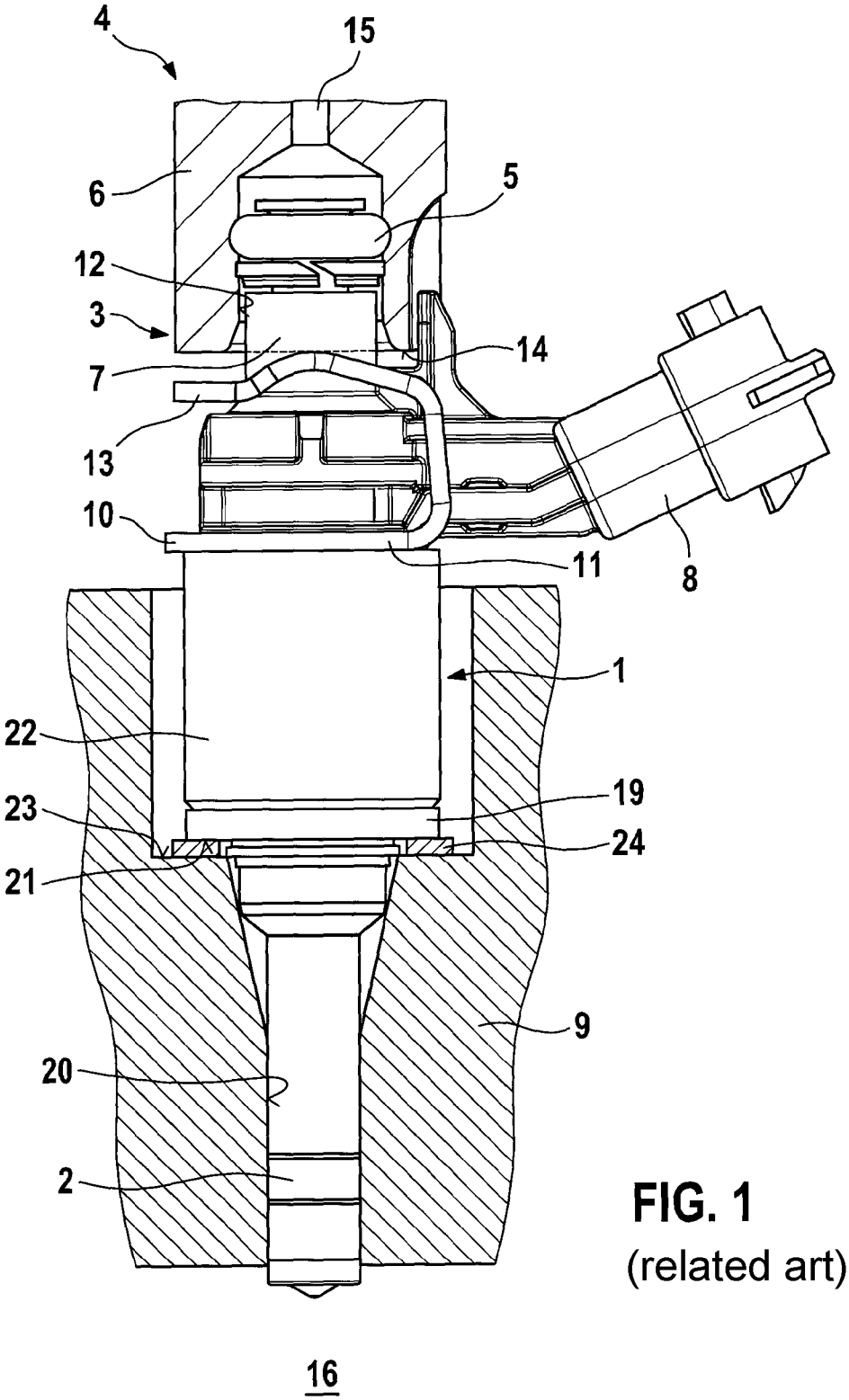
FIG. 1 (related art)
FIG. 1 shows a partially illustrated fuel injection device in a conventional embodiment.

For the purpose of understanding the present invention, a conventional specific embodiment of a fuel injection device is described in the following in greater detail based on FIG. 1. In FIG. 1, a valve in the form of an injector 1 for fuel injection systems of mixture-compressing, spark-ignited internal combustion engines is illustrated in a side view as one exemplary embodiment. Fuel injector 1 is part of the fuel injection device. With a downstream end, fuel injector 1, which is designed in the form of a directly injecting injector for directly injecting fuel into a combustion chamber 16 of the internal combustion engine, is installed in a receiving bore 20 of a cylinder head 9. A sealing ring 2, in particular made of PTFE or PTFE including fillers, ensures optimal sealing of fuel injector 1 with respect to the walls of receiving bore 20 of cylinder head 9.

Between a step 21 of a valve housing 22 (not shown) or a bottom front side 21 of a support element 19 (FIG. 1) and a shoulder 23 of receiving bore 20 running at a right angle to the longitudinal extension of receiving bore 20, for example, an intermediate element 24 is inserted that is used as a damping or decoupling element, for example. With the aid of such an intermediate element 24, manufacturing and installation tolerances are also compensated for and a mounting that is free of transverse forces may also be ensured even if fuel injector 1 is slightly tilted.

At its end 3 on the intake side, fuel injector 1 has a plug connection to a fuel distribution rail (fuel rail) 4 that is sealed by a sealing ring 5 between a connecting piece (rail cup) 6 of fuel distribution rail 4, which is illustrated in a sectioned manner, and an intake nozzle 7 of fuel injector 1. Fuel injector 1 is inserted into a receiving opening 12 of connecting piece 6 of fuel distribution rail 4. Connecting piece 6 is designed in one piece with actual fuel distribution rail 4, for example, and has upstream from receiving opening 12 a flow opening 15, which has a smaller diameter and via which the inflow of fuel injector 1 takes place. Fuel injector 1 has an electrical connector plug 8 for electrical contacting for the actuation of fuel injector 1.

Electrical connector plug 8 is connected via corresponding electrical connections to an actuator (not shown), through whose excitation a lifting motion of a valve needle is achievable, as a result of which an actuation of a valve closing body, which forms a sealing seat together with a valve mating surface, is made possible. The latter components are not explicitly illustrated and may have any sufficiently conventional design. The actuator may be operated in an electromagnetic, a piezoelectrical, or a magnetostrictive manner.

In order to space fuel injector 1 and fuel distribution rail 4 apart from one another in a largely radial force-free manner and to reliably hold down fuel injector 1 in receiving bore 20 of cylinder head 9, a hold-down device 10 is provided between fuel injector 1 and connecting piece 6. Hold-down device 10 is designed as a U-shaped component, for example as a punched-bent part. Hold-down device 10 includes a partially annular base element 11, from which a bent off hold-down bracket 13 extends that is in contact at a downstream end surface 14 of connecting piece 6 at fuel distribution rail 4 in the installed state.

Figure 2:
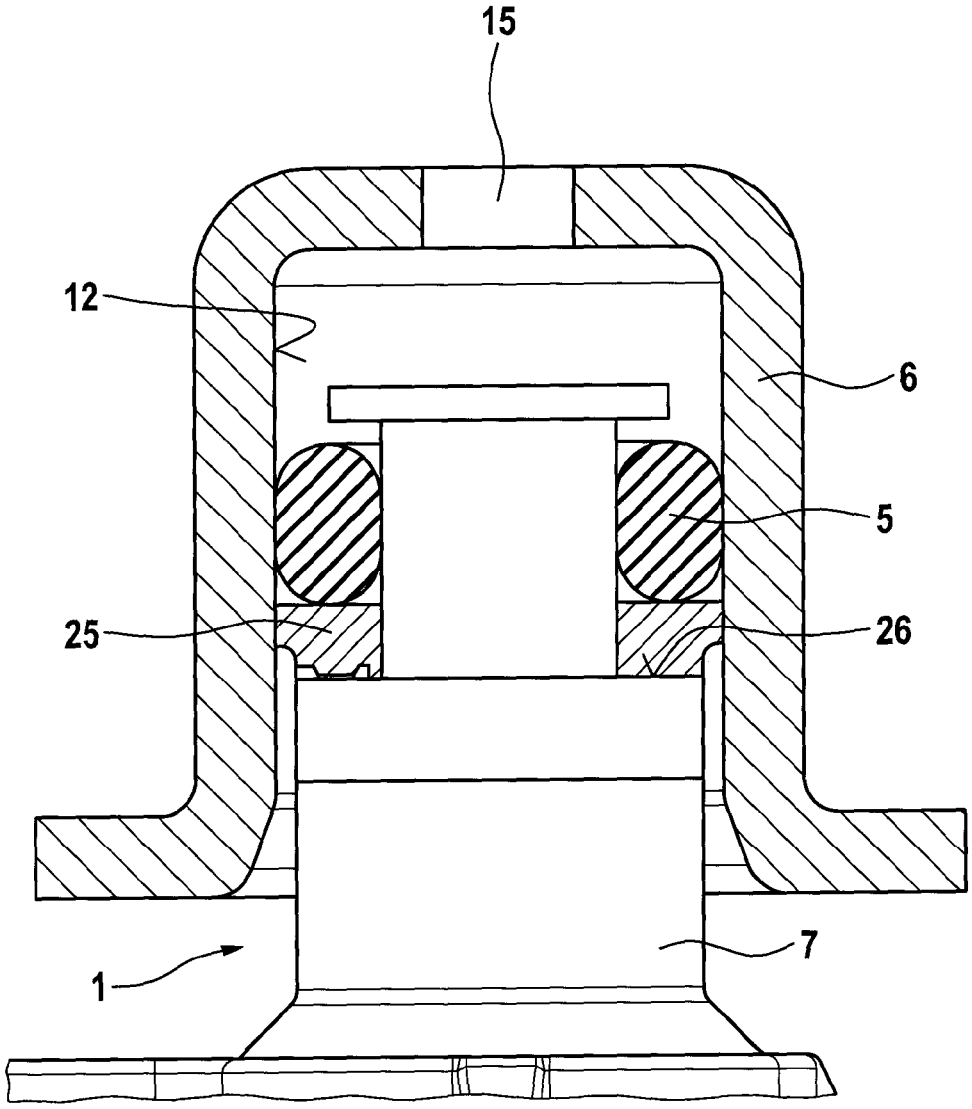
FIG. 2 (related art)
FIG. 2 shows a first conventional hydraulic interface in the area of a receiving opening of the fuel distribution rail.
Figure 3:
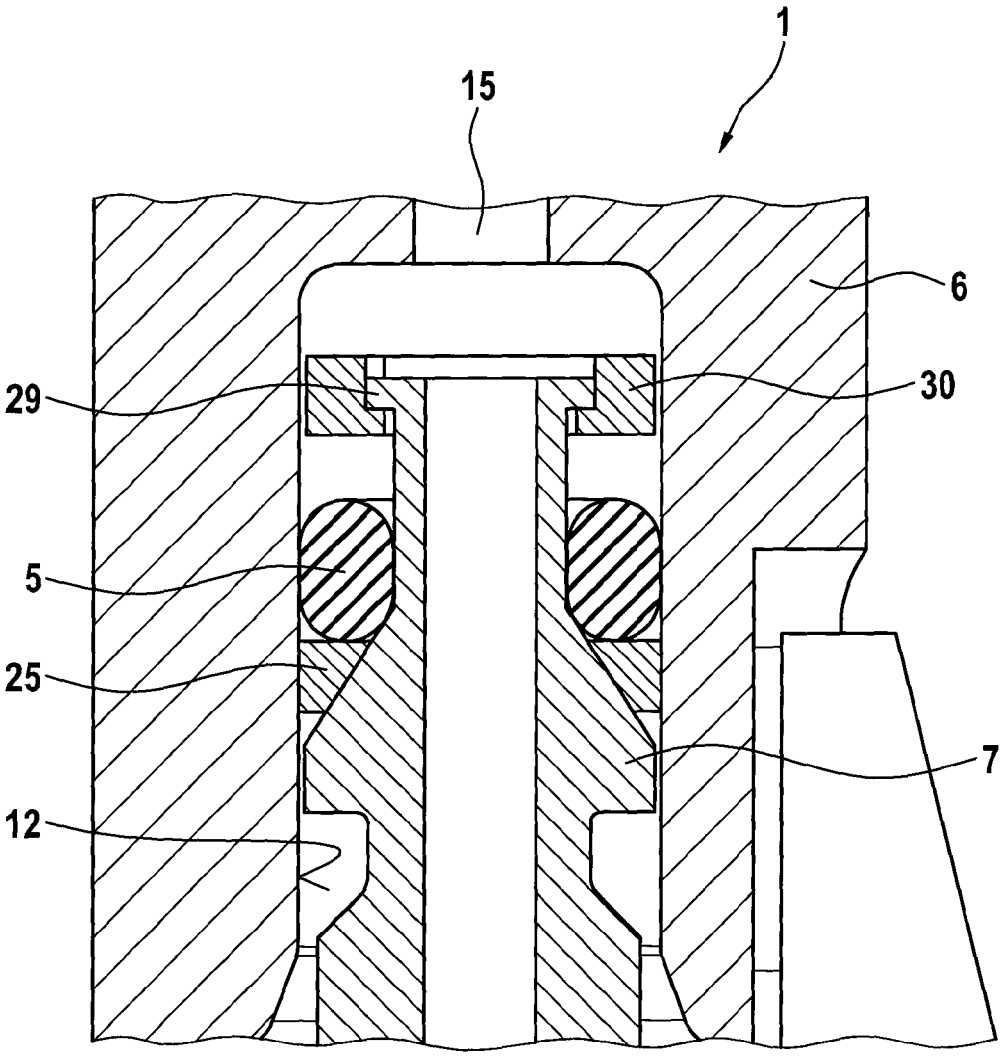
FIG. 3 (related art)
FIG. 3 shows a second conventional hydraulic interface in the area of a receiving opening of the fuel distribution rail.

In FIGS. 2 and 3, conventional hydraulic interfaces are illustrated in the area of receiving openings 12 of fuel distribution rail 4, the design shown in FIG. 2 being similar to that in FIG. 1. In this embodiment, intake nozzle 7 of fuel injector 1 is cylindrical. Sealing ring 5 is clamped between the inner wall of receiving opening 12 and intake nozzle 7. In addition, a support ring 25, which is supported at a shoulder 26 of intake nozzle 7, for example, is provided below sealing ring 5. Fuel injector 1 is radially supported via support ring 25. A slipping of sealing ring 5 is thus excluded. As a result, the pressing of sealing ring 5 is not affected.

In contrast to the design of the hydraulic interface in the area of receiving opening 12 of fuel distribution rail 4 of FIG. 2, a conical section that is enclosed by support ring 25 also having a conical inner opening and partially by sealing ring 5 is provided at intake nozzle 7 of fuel injector 1 illustrated in FIG. 3. Due to a force distribution of the radial force at the conical walls of intake nozzle 7, also into an axial force component inter alia, there is a risk of a one-sided slipping of sealing ring 5 upward and away from the conical section when the axial force of support ring 25 is greater than the displacement force of sealing ring 5. This slipping could involve a reduction of the pressing of sealing ring 5. In this embodiment of fuel injector 1, same thus has a radial support disk 30 at its end 3 on the intake side in the area of an end collar 29 for loss-preventing retaining. Radial support disk 30 is designed as a thin, but compact, disk that may be made of plastic (for example PEEK, PPS, POM) or from metal (for example aluminum). Radial support disk 30 is installed, for example, axially from above on fuel injector 1 via an auxiliary mandrel. Alternatively, radial support disk 30 may be installed with the aid of an expanding gripper or a similar tool. Radial support disk 30 is thus situated upstream from sealing ring 5 viewed in the flow direction.

Figure 4:
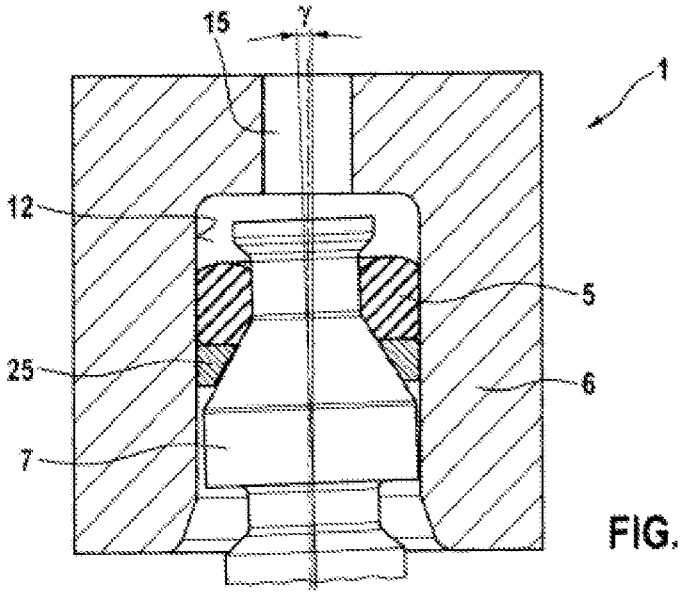
FIG. 4 (related art)
FIG. 4 shows a schematic and exaggerated illustrated installation situation under fuel pressure in the case of the approach from FIG. 3.
Figure 5:
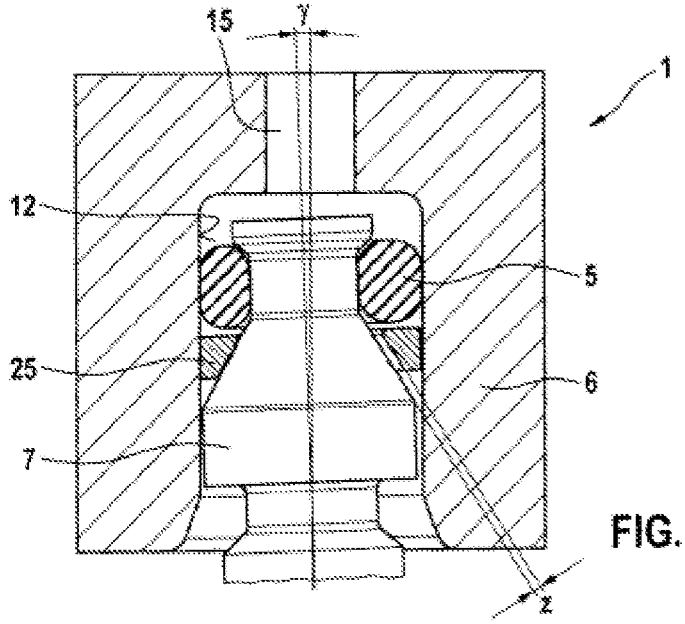
FIG. 5 (related art)
FIG. 5 shows a schematic and exaggerated illustrated installation situation without influence of the fuel pressure in the case of the approach from FIG. 3.

In FIGS. 4 and 5, a schematic and exaggerated illustrated installation situation under fuel pressure (FIG. 4) as well as without influence of the fuel pressure (FIG. 5) is illustrated for the approach from FIG. 3. This is to illustrate (not true to scale) that a gap z may form on one side between the conical walls of intake nozzle 7 and support ring 25 (FIG. 5) as a result of tolerance-induced tilted positions of intake nozzle 7 of fuel injector 1 with regard to receiving opening 12 of connecting piece 6 of fuel distribution rail 4, which is characterized by angle y. Under fuel pressure, sealing ring 5 is displaced by the hydraulic force in the axial direction toward support ring 25. A tilted position of intake nozzle 7 of fuel injector 1 could result in that intake nozzle 7 also migrates radially slightly to one side until a contact takes place between intake nozzle 7 of fuel injector 1 and the inner wall of receiving opening 12, so that a radial force is transferrable via fuel injector 1 to connecting piece 6. In such a case, there would be disadvantageously a risk of damage to connecting piece 6. In addition, sealing ring 5 could be damaged when replacing fuel injector 1. Moreover, as a result of the contact between fuel injector 1 and the inner wall of receiving opening 12, the noise behavior would become worse.

In the same manner of presentation as in FIGS. 3 through 5, FIG. 6 now shows a hydraulic interface in the area of a receiving opening 12 of fuel distribution rail 4 with a circumferential support ring 25 according to the present invention that is pushed onto intake nozzle 7 of fuel injector 1 prior to the optional attachment of an above-mentioned radial support disk 30 or another type of retaining element. According to the an example embodiment of present invention, support ring 25, which is being acted on by sealing ring 5, is provided with a V-shaped (in cross section), indent-like conical contact surface for sealing ring 5 that ensures that in the case of increased pressures a minor radial escape of sealing ring 5 in a radially inward and outward manner is made possible and thus radial gaps are prevented.

Figure 6:
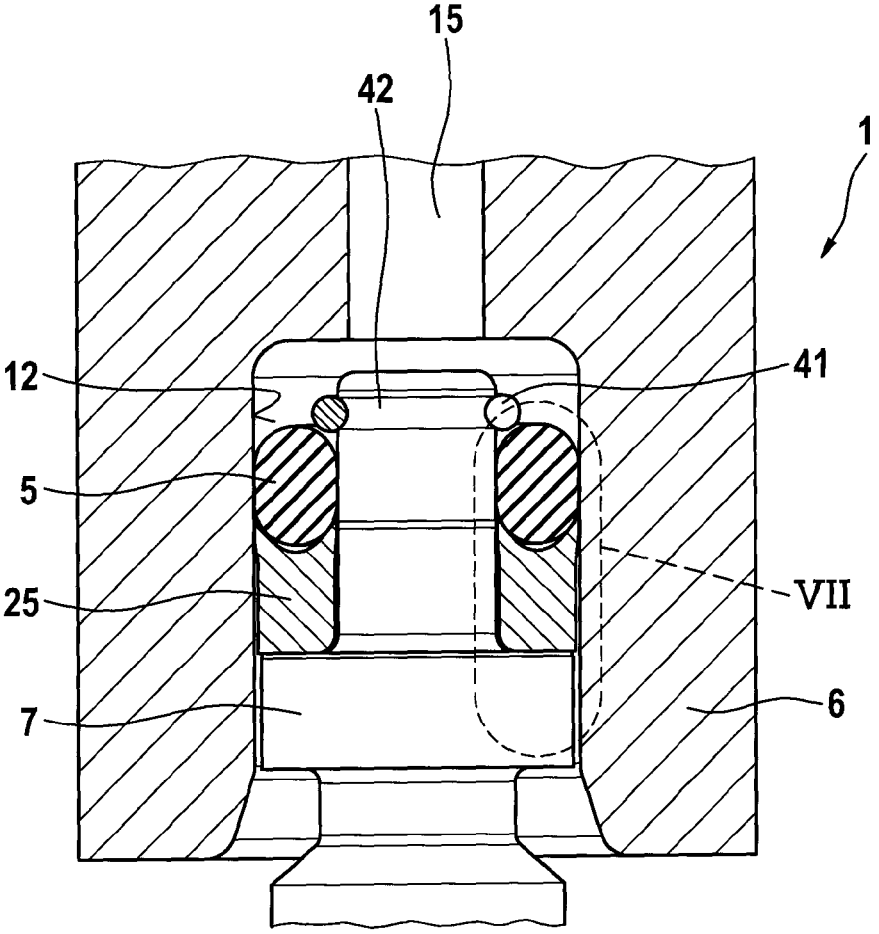
FIG. 6 shows a hydraulic interface in the area of a receiving opening of the fuel distribution rail including a support ring according to an example embodiment of the present invention and a retaining ring.
Figure 7:
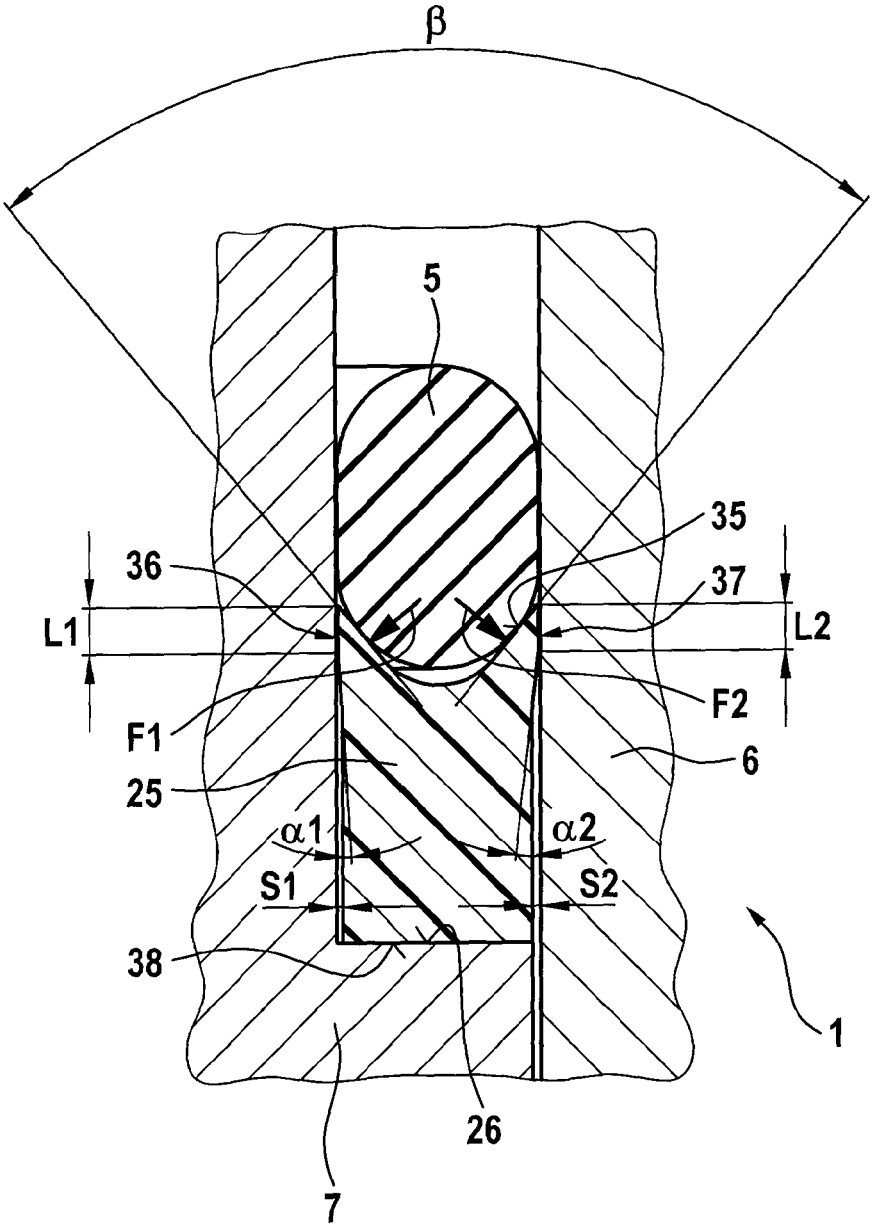
FIG. 7 shows the section indicated by VII in FIG. 6 including a support ring designed according to the an example embodiment of the present invention and a sealing element being applied thereto.

FIG. 7 illustrates the section indicated by VII in FIG. 6 including a support ring 25 designed according to the present invention and a sealing ring 5 being applied thereto. Support ring 25 is characterized by its V-shaped contact surface 35 for sealing ring 5. In its upper area facing sealing ring 5 having V-shaped contact area 35, support ring 25 has a slightly larger radial extension than over the remaining axial extension of support ring 25. In this way, it is possible to insert support ring 25 into the receiving space between fuel injector 1 and connecting piece 6 already by pressing this upper area of support ring 25 in a mild radial manner. As a result of the fluid pressure, two force components act via sealing ring 5 on the two wings of V-shaped contact surface 35 of support ring 25, which are indicated by F1 and F2 in FIG. 7. These forces F1 and F2 result in a minor elastic deformation of support ring 25, namely in the thin-walled sections radially inside and outside below contact surface 35 in the radially slightly larger upper area. In the case of increased fluid pressures, a radial escape and pressing of support ring 25 radially inside and outside thus additionally takes place, so that radial gaps, such as for example shown in FIG. 5 with the aid of gap z, are always prevented. Two sealing areas 36 and 37 are rather formed between support ring 25 and intake nozzle 7 radially inside and between support ring 25 and connecting piece 6 radially outside due to the shaping of support ring 25. Axial lengths L1 and L2 of sealing areas 36 and 37 are each approximately 0.2 mm through 0.8 mm. A radial additional force, such as elucidated in the context of FIG. 4, advantageously cannot be transferred under any circumstances from fuel injector 1 to connecting piece 6 of fuel distribution rail 4. With its base surface 38 that is opposite V-shaped contact surface 35, support ring 25 is in contact with right-angled shoulder 26 of intake nozzle 7 of fuel injector 1 and is correspondingly supported there.

Support ring 25 is advantageously manufactured from plastic, the material PA66 including 30% glass fibers also being suitable, for example. In the original as well as in the stressed and pressed states of support ring 25, such as the one shown in FIG. 7, the radial inner and outer sides of support ring 25 run starting from sealing areas 36 and 37 at least over an axial partial distance at an angle in each case that deviates by 90° with regard to the horizontal, so that gap angles $\alpha 1$ and $\alpha 2$ of approximately 2° through 8° are formed. Below sealing areas 36 and 37, support ring 25 is thus not pressed against the walls of intake nozzle 7 or connecting piece 6. Gap widths S1 and S2 of the gap between support ring 25 and the walls of intake nozzle 7 radially inside or of connecting piece 6 radially outside are approximately 0.1 mm through 0.5 mm in each case. V-shaped contact surface 35 of support ring 25 does not have to centrally taper, but may also be slightly rounded in the center, as shown in FIG. 7. Angle $\beta$ between the two wings of V-shaped contact surface 35 of support ring 25 is approximately 60° through 100°.

Figure 8:
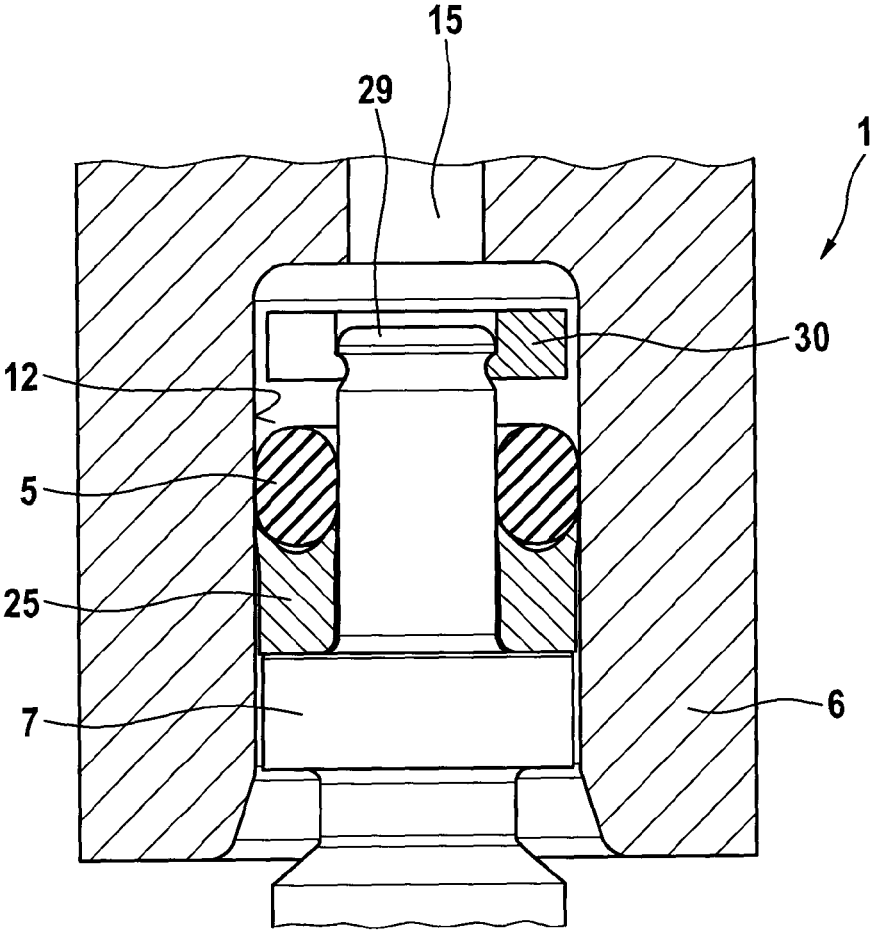
FIG. 8 shows a hydraulic interface in the area of a receiving opening of the fuel distribution rail including a support ring according to an example embodiment of the present invention and a disk-shaped loss-preventing retainer.

According to FIG. 6, sealing ring 5 is secured with the aid of a retaining ring 41 as the axial installation retaining element, retaining ring 41 being inserted into a ring groove 42 inserted above sealing ring 5 at intake nozzle 7. Retaining ring 41 has, for example, a slotted design and a circular or square-shaped cross section. Alternatively, as shown in FIG. 8, a radial support disk 30, which is attached in the area of end collar 29, may also be provided as a loss-preventing retainer at end 3 of fuel injector 1 on the intake side. Radial support disk 30 is designed as a thin, but compact, disk.

Figure 9:
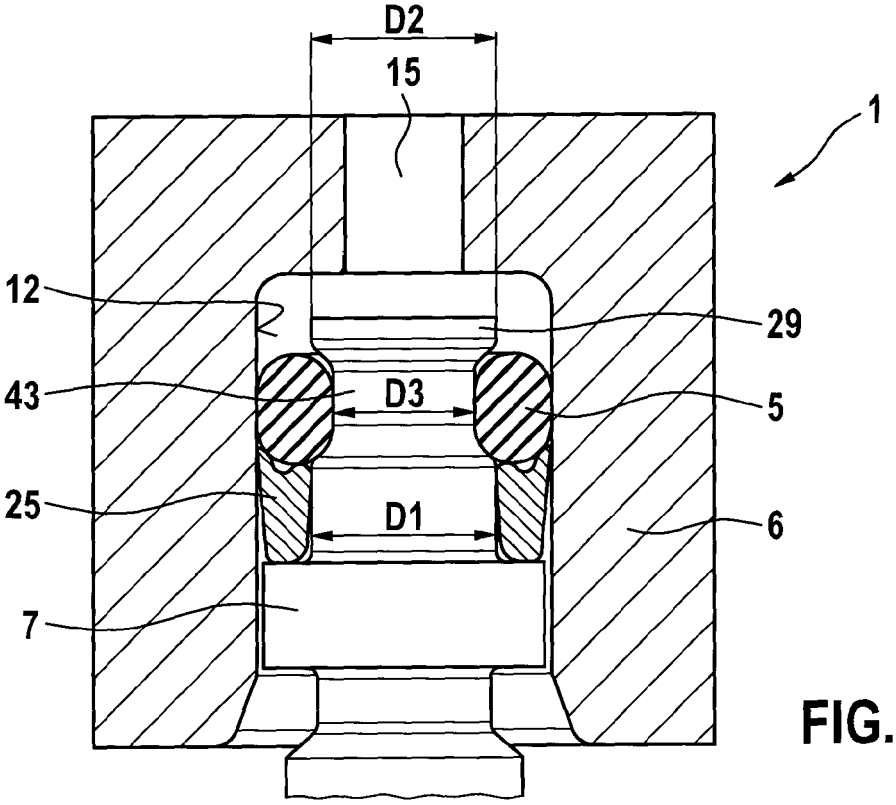
FIG. 9 shows a hydraulic interface in the area of a receiving opening of the fuel distribution rail including a further support ring according to an example embodiment of the present invention without influence of the fuel pressure.

FIG. 9 shows a hydraulic interface in the area of a receiving opening 12 of fuel distribution rail 4 including a further support ring 25 according to the present invention without influence of the fuel pressure. This exemplary embodiment is characterized in that diameter D2 of end collar 29 of intake nozzle 7 and diameter D1 of intake nozzle 7 at the height of support ring 25 are selected to have the same size. It is possible in this way to install support ring 25 via end collar 29 without any problems. In this embodiment, support ring 25 has two wings of V-shaped contact surface 35 that extend to different heights, for example, the radially inner wing having a smaller height in the axial direction than the height of the radially outer wing. This may be advantageous, as shown in the present example, when sealing ring 5 is inserted into a receiving groove 43 that is somewhat indented with regard to end collar 29 and the receiving area for support ring 25 (D1, D2) at intake nozzle 7 having a smaller diameter D3.

Figure 10:
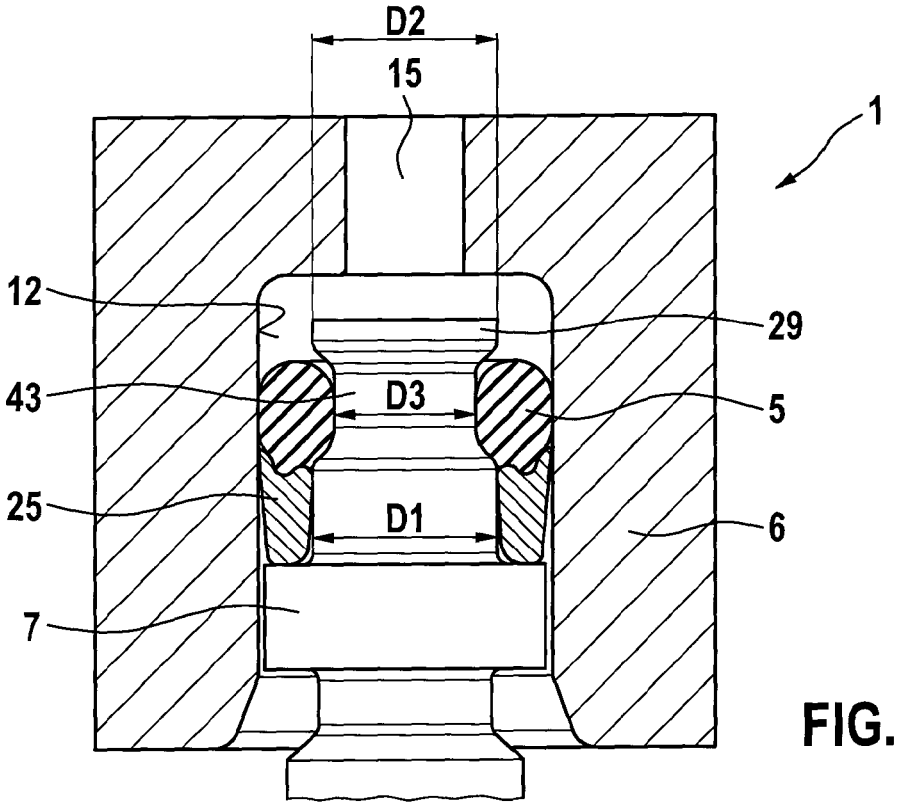
FIG. 10 shows a hydraulic interface in the area of a receiving opening of the fuel distribution rail including a support ring according to FIG. 9 under fuel pressure.

FIG. 10 shows the hydraulic interface in the area of a receiving opening 12 of fuel distribution rail 4 including a support ring 25 according to FIG. 9 under fuel pressure. In this way, it is schematically shown that sealing ring 5 may slightly migrate together with its material under fuel pressure from radially inside via the radially inner wing of V-shaped contact surface 35 of support ring 25 in same between the wings.

What is claimed is:

1. A fuel injector for a fuel injection system of an internal combustion engine, comprising:

an actuator, through whose excitation a lifting movement of a valve needle is achieved, as a result of which an actuation of a valve closing body, which forms a sealing seat together with a valve mating surface, occurs;

an intake nozzle on an intake side for a fuel supply; and a sealing ring enclosing the intake nozzle, the sealing ring being engaged by a support ring that has a contact surface, which faces the sealing ring and is V-shaped in cross section, wherein the V-shaped contact surface of the support ring has two wings, on which two force components act via the sealing ring when fluid pressure acts on them, wherein an angle between the two wings of the V-shaped contact surface of the support ring is approximately 60° through 100°.

2. The fuel injector as recited in claim 1, wherein the fuel injector is configured to directly inject fuel into a combustion chamber of the internal combustion engine.

3. The fuel injector as recited in claim 1, wherein in thin-walled areas radially inside and outside below the contact surface, a minor elastic deformation of the support ring in a radial direction is made possible.

4. The fuel injector as recited in claim 3, wherein in a pressed state, two sealing areas, whose axial lengths are each approximately 0.2 mm through 0.8 mm, are formed between the support ring and the intake nozzle radially inside and between the support ring and a connecting piece radially outside.

5. A fuel injector for a fuel injection system of an internal combustion engine, comprising:

an actuator, through whose excitation a lifting movement of a valve needle is achieved, as a result of which an actuation of a valve closing body, which forms a sealing seat together with a valve mating surface, occurs;

an intake nozzle on an intake side for a fuel supply; and a sealing ring enclosing the intake nozzle, the sealing ring being engaged by a support ring that has a contact surface, which faces the sealing ring and is V-shaped in cross section, wherein the V-shaped contact surface of the support ring has two wings, on which two force components act via the sealing ring when fluid pressure acts on them, wherein in thin-walled areas radially inside and outside below the contact surface, a minor elastic deformation of the support ring in a radial direction is made possible, wherein in a pressed state, two sealing areas, whose axial lengths are each approximately 0.2 mm through 0.8 mm, are formed between the support ring and the intake nozzle radially inside and between the support ring and a connecting piece radially outside, wherein the radial inner and outer sides of the support ring extend, starting from the sealing areas, at least over an axial partial distance at an angle in each case, so that below the sealing areas, the support ring is spaced apart from walls of the intake nozzle or the connecting piece.

6. The fuel injector as recited in claim 5, wherein gap widths of gaps between the support ring and the walls of the intake nozzle radially inside or of the connecting piece radially outside are each approximately 0.1 mm through 0.5 mm.

7. The fuel injector as recited in claim 1, wherein the V-shaped contact surface of the support ring is rounded in a center of the V.

8. A fuel injector for a fuel injection system of an internal combustion engine, comprising:

an actuator, through whose excitation a lifting movement of a valve needle is achieved, as a result of which an actuation of a valve closing body, which forms a sealing seat together with a valve mating surface, occurs;

an intake nozzle on an intake side for a fuel supply; and a sealing ring enclosing the intake nozzle, the sealing ring being engaged by a support ring that has a contact surface, which faces the sealing ring and is V-shaped in cross section, wherein the V-shaped contact surface of the support ring has two wings, on which two force components act via the sealing ring when fluid pressure acts on them, wherein a radial inner wing of the V-shaped contact surface of the support ring is lower in its axial extension than a radial outer wing of the V-shaped contact surface of the support ring.

9. A fuel injector for a fuel injection system of an internal combustion engine, comprising:

an actuator, through whose excitation a lifting movement of a valve needle is achieved, as a result of which an actuation of a valve closing body, which forms a sealing seat together with a valve mating surface, occurs;

an intake nozzle on an intake side for a fuel supply; and a sealing ring enclosing the intake nozzle, the sealing ring being engaged by a support ring that has a contact surface, which faces the sealing ring and is V-shaped in cross section, wherein at an end of the intake nozzle on the intake side, a retaining ring is situated configured for loss-preventing retaining of the sealing ring in an installed state.

10. The fuel injector as recited in claim 1, wherein at an end of the intake nozzle on the intake side, a radial support disk is situated for loss-preventing retaining of the fuel injector in an installed state.

11. The fuel injector as recited in claim 1, wherein the support ring is made from plastic.

12. The fuel injector as recited in claim 1, wherein the support ring is made from polyamide PA66.

* * * * *